US005535506A

United States Patent [19]

Chalfin

[11] Patent Number: 5,535,506

[45] Date of Patent: Jul. 16, 1996

[54] APPARATUS FOR THE RIGHT-SIDE UP APPLICATION OF JEWELS TO FABRIC

[75] Inventor: Bernard Chalfin, Tenafly, N.J.

[73] Assignee: Geisler Ganz Corporation, Secaucus, N.J.

[21] Appl. No.: 285,049

[22] Filed: Aug. 4, 1994

[51] Int. Cl.[6] ..... B23P 19/00; B23P 5/00

[52] U.S. Cl. ..... 29/798; 29/10; 29/281.5; 29/283; 269/7

[58] Field of Search ..... 29/251, 424, 432.1, 29/798, 10, 281.5, 283, DIG. 1, DIG. 47; 206/813; 269/7; 451/389, 390

[56] References Cited

U.S. PATENT DOCUMENTS

| | | | |
|---|---|---|---|
| 1,138,354 | 5/1915 | Catucci | 451/389 X |
| 1,214,009 | 1/1917 | Coleman | 451/389 X |
| 2,451,194 | 10/1948 | Braun | 206/813 X |
| 2,631,281 | 3/1953 | Hardy et al. | 29/101 X |
| 2,641,879 | 6/1953 | Dalrymple | 29/424 |
| 2,878,954 | 3/1959 | Troske | 29/281.5 X |
| 3,461,622 | 8/1969 | Rayford | 451/389 |
| 3,483,603 | 12/1969 | Briskin | 29/10 |
| 3,911,722 | 10/1975 | Levine et al. | 29/798 X |
| 5,367,837 | 11/1994 | Tolkowsky | 451/389 |

*Primary Examiner*—Joseph M. Gorski
*Attorney, Agent, or Firm*—Gottlieb, Rackman & Reisman

[57] ABSTRACT

An apparatus and method for permanently attaching to fabric in a right-side up orientation decorative objects such as rhinestones or nailheads using conventional setting hardware such as tiffany settings and/or rim settings and nail heads. The apparatus employs an upper die having a bore filled with a viscous material that extends into a lower groove of the upper die and a pressure closure to permit maintaining the amount of viscous material in the groove.

6 Claims, 2 Drawing Sheets

FIG. 1
PRIOR ART
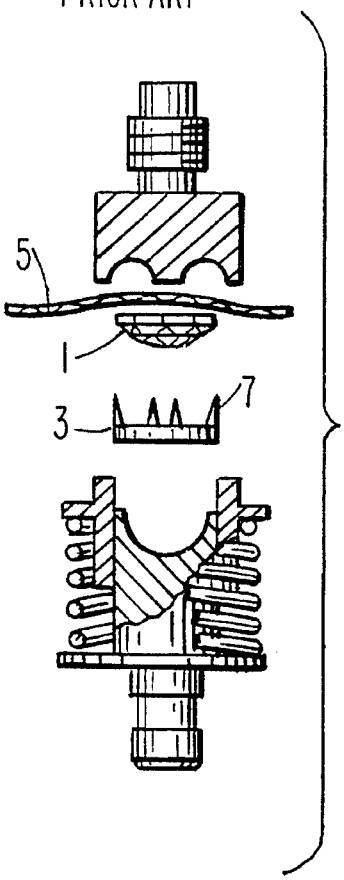
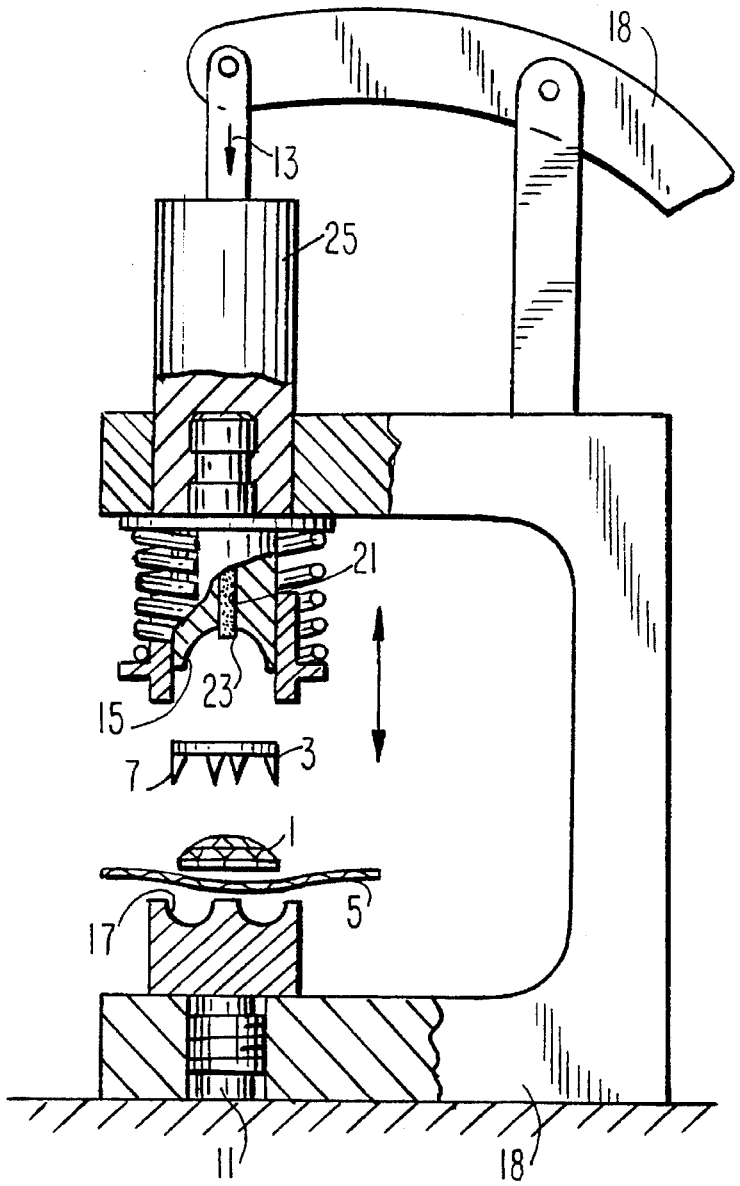
FIG. 2

FIG. 3
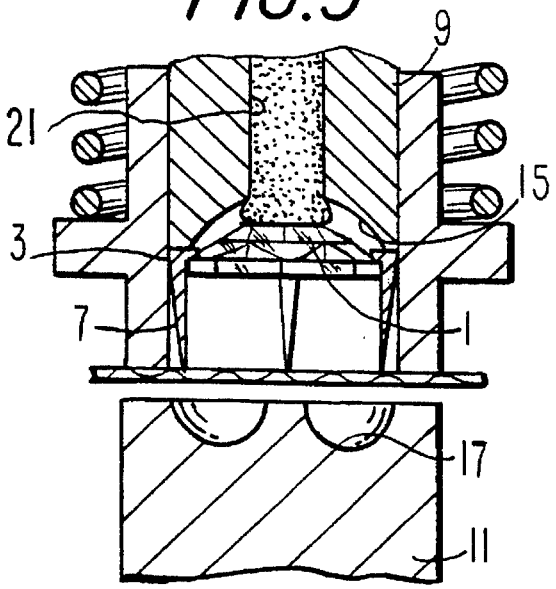
FIG. 4
PRIOR ART
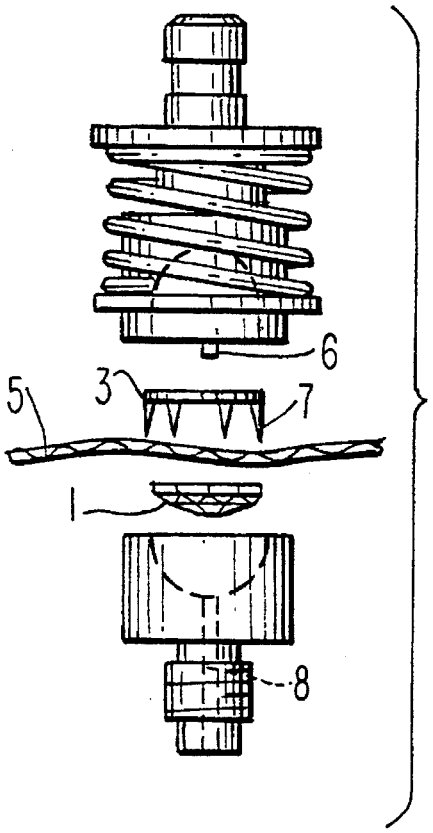
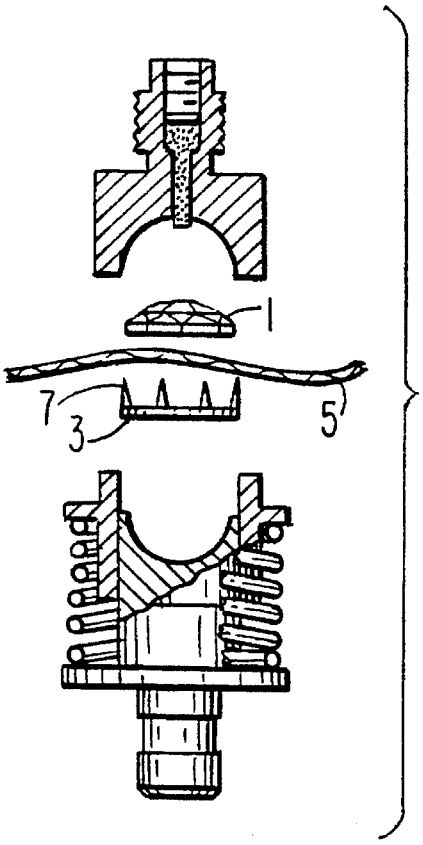
FIG. 5

APPARATUS FOR THE RIGHT-SIDE UP APPLICATION OF JEWELS TO FABRIC

This invention relates to apparatus and methods for permanently attaching to fabric decorative objects such as rhinestones using conventional setting hardware such as tiffany settings, rim settings or nailheads. In particular the invention relates to enabling such attachment in a right-side up configuration in which the decorative object is above the fabric thus enabling an operator of the apparatus to have a clear view of the pattern to which the object is being attached. The invention is applicable to settings that are placed above the fabric (e.g., rim settings) or below the fabric (e.g., tiffany settings).

BACKGROUND OF THE INVENTION

Presently, rhinestones and nailheads are attached to textile products while the fabric is face down using hand, foot and mechanical or pneumatic presses fitted with a set of dies. In the case of rhinestones, either a rim setting, nail head or tiffany type setting is used. In the case of a rim setting, as shown in FIG. 1, which represents the prior art, the setting is placed face down in a bottom die that comprises a recess having a spring loaded sleeve. The upper die has an annular grove, and is activated downwardly to force the upward facing prongs of the rim setting through the fabric and then roll the prongs securely.

In the case of tiffany settings, as shown in FIG. 4, also representative of the prior art, the stone is placed face down in a cupped recess of the bottom die having a bore hole 8 running through its length. This hole permits chips of glass that would otherwise build up during repeated usage to drop through. The upper die has a spring loaded tapered pin 6 onto which is placed the tiffany setting. Placing the fabric between the dies, the prongs of the tiffany setting are forced through the fabric onto the cup shaped bottom die thus securing the rhinestone.

Manufacturers have adapted such apparatus to attach rhinestones in a right-side up orientation by having a hole drilled in the upper die (previously the lower die) and attaching an air fitting. This air fitting is attached to a vacuum pump using plastic tubing. Usually gangs of four or six presses are attached to a single pump. This permits a tiffany setting die to be used right side up by attaching the former bottom die (cupped) in the upper ram, and the former upper die (receding pin) in the lower press position. The vacuum holds the rhinestone securely face up in the upper die but allows it easily to be removed once the rhinestone is applied.

Similar considerations apply to rim setting dies and nailheads, which have the same construction as rim setting dies. Special dies are used which have a hole passing lengthwise through the post and shank permitting the vacuum to hold the nailhead face up (i.e., prongs down) in the upper die. All of these embodiments suffer from having to employ expensive vacuum devices.

U.S. Pat. No. 2,641,879 issued Jun. 16, 1953, discloses a method for temporarily mounting work pieces of minute dimension particularly for grinding and polishing operations of materials such as glass, plastics or metal in the manufacture of ornamental and industrial jewels, imitation stones, beads, bearings, buttons and the like. This patent describes an alternative to prior systems that used a readily meltable metal, a cement, an adhesive, plaster of Paris or pitch to attach the work piece to a holder. (Col. 1, line 35) The '879 patent describes as an improvement a method for using a film of water deposited between the work piece and the work support which is alternately frozen and thawed. A drawback of this system is immediately obvious. It is necessary to carefully control the temperature of the work Support so that the water is always in the correct phase (water or ice). That obviously requires the expense of refrigeration equipment.

U.S. Pat. No. 2,414,598 issued Jan. 21, 1947, similarly discloses apparatus useful in the grinding of facets on precious stones. The apparatus comprises a holder made of a soft metal such as copper, aluminum, etc. (Col. 2, line 33) This is seated upon a hardened portion of the holder. A tool is forced down upon the stone driving it into the soft metal which conforms to the shape of the stone and holds it during subsequent grinding operations. The disclosure of that patent is not adaptable to solve the problem of the present invention. Rhinestones are not hard enough to survive being driven into a soft metal. Furthermore, the procedure would require an additional stamping operation merely to retain the stone. The operation would be performed with gravity supporting the work piece prior to the first stamping operation. Nothing in that patent suggests a solution to the problem encountered in having to invert settings in the prior art.

BRIEF DESCRIPTION OF THE PRESENT INVENTION

The present invention is designed to permit affixing to fabric rhinestones in settings while the fabric is right-side up, without the need for vacuum pumps. This eliminates a marking operation to locate the stones on the fabric since the operator can see exactly where the decorative object is being placed. This is important with silk screened and printed patterns, appliques, braid, stitching, etc. The elimination of the vacuum pump permits operation of the system at any convenient location.

The above description, as well as further objects, features and advantages of the present invention, will be more fully appreciated by reference to the following detailed description of a presently preferred, but nonetheless illustrative, embodiment in accordance with the present invention when taken in conjunction with the accompanying drawings.

BRIEF DESCRIPTION OF THE DRAWINGS

FIG. 1 is a side view of a prior art rim setting apparatus.

FIG. 2 is a side view of the rim setting apparatus of the present invention.

FIG. 3 is an enlarged view including the upper die of the rim setting apparatus of the present invention.

FIG. 4 is a side view of the tiffany setting apparatus of the prior art.

FIG. 5 is a side view of apparatus of the tiffany setting apparatus of the present invention.

DETAILED DESCRIPTION OF A PREFERRED EMBODIMENT

The system of the present invention is shown generally in FIG. 2. The apparatus is designed for the purpose of attaching a decorative article such as a rhinestone 1 held in a rim setting 3 to a fabric 5. The fabric 5 may be leather or plastic as well as cloth and may have on its upper surface a design that guides the location of the rhinestone 1. The setting 3 in this embodiment may be a rim setting or nailhead having prongs which are capable of penetrating the fabric and if properly bent forming the structure that retains the rhinestone to the fabric while allowing the upper surface of the rhinestone to be visible from above.

An upper die 9 and a lower die 17 are used to compress the setting and cause the prongs to bend inward towards the axis 13 of the dies. The invention is concerned with the mechanism that retains the rhinestone 1 and its setting 3 against gravity in a sleeve 26 located at the lower end of the upper die 9. FIG. 3 shows in an enlarged view the relation of the setting and the rhinestone to the sleeve.

The lower die 31 has a recess 17 to receive and deform the prongs 7 of the setting. Both dies are held in a drive means, for example a foot operated press shown schematically at 18. Such presses are well known in the art. The press holds the dies by their respective shanks 31 and 14. Flanges 19 and 21 restrict movement of the dies. The press is capable of driving the two dies towards each other along their axis 13, a process called "approximation".

The upper die 9 has a bore 21 preferably axially oriented and running the full length of the upper die. The bore opens into the groove 15. The bore is filled with a viscous material, preferably a tacky, or gummy paste, that extends beyond the end of the bore 21 into the groove 15. A small quantity 23 is shown in FIG. 2 capable of contacting the stone.

The viscous material 23 holds the stone and the setting against their tendency to fall under their weight. The viscous material should not be a strong adhesive since only a temporary attachment is desired. Non-hardening putty is a suitable material as well as various non-hardening grouts. The material 23 need only contact the stone, since in the orientation of this preferred embodiment the rim setting cannot fall due to the way that it fits onto the stone. But it is not outside the scope of this invention to have the material 23 contact both the stone and the setting.

A pressure closure 25 is provided by a screw at the top end of the bore 21. This is further depicted in FIG. 5 with regard to an alternative embodiment. The pressure closure causes the material filling the bore to be extruded at the lower end of the bore into the groove 15 thereby providing a mechanism to maintain the small quantity of material 23 in the groove 15. In this manner any viscous material that may be removed when the stone is withdrawn from the press after multiple stamping may be replaced.

The description that has been given for rim settings or for nailheads requires only minor modifications for the case of the tiffany setting. FIGS. 4–5 for tiffany settings correspond generally to FIGS. 1–2 for rim or nailhead settings. The principle difference is that a tiffany setting is located on the opposite side of the fabric than the stone. Hence, in the tiffany setting embodiment, only the stone is placed in contact with the adhesive in the upper die, while the setting remains in the lower die.

While there have been shown and described and pointed out the fundamental novel features of the invention as applied to preferred embodiments thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

I claim:

1. Apparatus for attaching to fabric in a right-side up orientation decorative stones and rim or nail head settings having prongs comprising a cylindrical upper die member having a recess at a lower end of said die member, said recess being symmetric about an axis of said cylindrical upper die member and configured to receive the rim or nail head setting and the decorative stone, said upper die member having a bore therethrough, said bore having a first end opening into said recess, and a second end terminating in pressure closure means, extrudable viscous material filling said bore between its first end and said pressure closure means and extending into said recess, wherein a decorative stone received into said recess contacts said viscous material, said viscous material having sufficient adhesion to support a setting and decorative stone in contact with said viscous material against falling due to their weight, said pressure closure means being adjustable to extrude said viscous material through said bore into said recess, a lower die having a second recess in an upper end opposite and facing the recess in said upper die, drive means to approximate said upper and lower dies under operator control, wherein the prongs of said setting pass through the fabric and are deformed to create an attached decorative article.

2. The apparatus for attaching decorative stones of claim 1, wherein said settings are rim settings and said bore is oriented along the axis of said upper die.

3. The apparatus for attaching decorative stones of claim 1, wherein said pressure closure means comprises a screw threaded into the second end of said bore.

4. Apparatus for attaching to fabric in a right-side up orientation decorative stones and tiffany settings having prongs comprising a cylindrical upper die member having a recess at a lower end of said die member, said recess being symmetric about an axis of said cylindrical upper die member and configured to receive the decorative stone, said upper die member having a bore therethrough, said bore having a first end opening into said recess, and a second end terminating in pressure closure means, extrudable viscous material filling said bore between its first end and said pressure closure means and extending into said recess, wherein a decorative stone received into said recess contacts said viscous material, said viscous material having sufficient adhesion to support the decorative stone in contact with said viscous material against falling due to its weight, said pressure closure means being adjustable to extrude said viscous material through said bore into said recess, a lower die having a second recess in an upper end opposite and facing the recess in said upper die and adapted to retain the tiffany setting with its prongs upwards, drive means to approximate said upper and lower dies under operator control, wherein the prongs of said setting pass through the fabric and are deformed to create an attached decorative article.

5. The apparatus for attaching decorative stones of claim 4, wherein said bore is oriented along the axis of said upper die.

6. The apparatus for attaching decorative stones of claim 4, wherein said pressure closure means comprises a screw threaded into the second end of said bore.

* * * * *